US008926089B2

(12) United States Patent
Muhl et al.

(10) Patent No.: US 8,926,089 B2
(45) Date of Patent: Jan. 6, 2015

(54) ARRANGEMENT TO PRINT TO STRIP-LIKE PRINT MEDIA

(71) Applicants: Wolfgang Muhl, Hohen Neuendorf (DE); Ulrich Hantel, Berlin (DE)

(72) Inventors: Wolfgang Muhl, Hohen Neuendorf (DE); Ulrich Hantel, Berlin (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 0 days.

(21) Appl. No.: 13/682,785

(22) Filed: Nov. 21, 2012

(65) Prior Publication Data

US 2013/0135416 A1 May 30, 2013

(30) Foreign Application Priority Data

Nov. 24, 2011 (DE) ..... 20 2011 108 254 U

(51) Int. Cl.

| | |
|---|---|
| ***B41J 3/407*** | (2006.01) |
| ***B65H 3/56*** | (2006.01) |
| ***B65H 3/04*** | (2006.01) |
| ***B41J 11/00*** | (2006.01) |
| ***B41J 15/04*** | (2006.01) |
| ***B41L 47/38*** | (2006.01) |
| ***B41L 47/48*** | (2006.01) |
| ***B41L 47/26*** | (2006.01) |
| ***B65H 1/02*** | (2006.01) |
| *G07B 17/00* | (2006.01) |

(52) U.S. Cl.

CPC ..... *B41J 11/007* (2013.01); *B65H 3/56* (2013.01); *G07B 2017/00556* (2013.01); *G07B 17/00508* (2013.01); *B65H 2405/211* (2013.01); *B65H 2402/324* (2013.01); *B65H 3/047* (2013.01); *G07B 2017/00524* (2013.01); *B65H 2701/1916* (2013.01); *B41J 15/04* (2013.01); *B41L 47/38* (2013.01); *G07B 2017/00241* (2013.01); *G07B 17/00467* (2013.01); *B41J 15/048* (2013.01); *B41L 47/48* (2013.01); *B41L 47/26* (2013.01); *B65H 3/045* (2013.01); *B65H 2701/192* (2013.01); *B65H 1/02* (2013.01)

USPC ..... 347/106; 347/101; 347/104

(58) Field of Classification Search

CPC ..... G07B 17/00467; G07B 17/00508; G07B 1/00; G07B 2017/00241; G07B 2017/00524; G07B 2017/00556; G07B 5/00; G07B 2017/00596

See application file for complete search history.

(56) References Cited

U.S. PATENT DOCUMENTS

| | | | |
|---|---|---|---|
| 6,109,713 | A | 8/2000 | Geserich et al. |
| 6,182,566 | B1 | 2/2001 | Kubatzki et al. |
| 6,773,524 | B2 | 8/2004 | Staufer et al. |
| 8,136,813 | B2 | 3/2012 | Hantel et al. |
| 2009/0153609 | A1 | 6/2009 | Muhl |

FOREIGN PATENT DOCUMENTS

| | | | |
|---|---|---|---|
| DE | 19823359 | C1 | 10/1999 |
| DE | 20218855 | U1 | 4/2003 |

*Primary Examiner* — Justin Seo

(74) *Attorney, Agent, or Firm* — Schiff Hardin LLP

(57) ABSTRACT

A printing apparatus has a transport module with a moving transport belt that transports strip-like print media past a printhead for printing thereon. The transport module has an entrance region upstream of the printhead, a magazine for the strip-like media located upstream of the entrance region of the transport module, the transport belt also serves as a take-off device to remove the strip-like media from the magazine, the magazine is mounted laterally offset with respect to the transport belt, thereby causing the strip-like media to be captured by the transport belt only in an edge region of the transport belt. The transport belt is wider by the edge region than is precisely needed to transport the strip-like media, in order to print on a remaining region of the strip-like media, which is smaller by the edge region than a total width of said strip-like media.

10 Claims, 11 Drawing Sheets

ARRANGEMENT TO PRINT TO STRIP-LIKE PRINT MEDIA

BACKGROUND OF THE INVENTION

1. Field of the Invention

The invention concerns an arrangement to print strip-like print media in a franking and/or addressing machine.

2. Description of the Prior Art

An arrangement of the aforementioned general type is known (see DE 197 12 077 C1) in which the print media are transported on edge, resting on a guide plate with a printing window, by means of contact pressure elements attached to a revolving transport belt, and the media are printed by an ink printhead located behind the printing window. In the entrance region of the otherwise typical print media, a strip magazine is arranged transversely to the guide plate and at a distance from the guide plate that is greater than the largest permitted thickness of the otherwise typical print media. The strip-like print media—simply strips in the following—are supplied as an output from a magazine transversely to the transport direction and above the transport plane of the transport belt toward the guide plate. For this purpose, the strip magazine is provided with a separate drive formed by a motor, reduction gear and drive roller. A recess is provided in the guide plate in the impact region of the strips, into which recess is inserted a specifically shaped guide part. The middle of the exit opening for the strips from the magazine, the middle of the guide part and the middle of the printing window are all situated at approximately the same level.

As is apparent from the above description, this solution is limited to only a specific, complicated transport system, and the technical design cost is also significant. The output relationships do not allow any reloading during operation.

A modular strip dispenser is known (see DE 202 18 855 U1) that is designed so as to be connectable with a mail processing machine. The strip dispenser has a shaft beam and a removable strip receiver shaft that is adapted in terms of its length to different strip lengths. Integrated into the shaft beam are a take-off unit and sensors that can be electrically connected with a control unit of the mail processing machine. The take-off unit has a stepper motor that can be controlled by software o as to produce a desired take-off speed, corresponding to the different machine variants. A sensor installed in the shaft beam checks whether a strip has been taken off or whether a strip is located in the strip guide. The strip receiver shaft has a mechanical sluice with which the maximum fill level is established. In the output region of the strip receiver shaft, two levers that can be moved against an elastic force are supported between the upper outer wall and the inner wall. The spring-loaded levers extend to the exit opening and press the strips against a take-off roller.

If only one or a few strips is/are isolated, the strips may be pushed too far through, and recurve at a blocking part, and therefore an error mode is triggered (given one strip) or an isolation is impossible (given multiple strips).

In addition to the technical cost for the separate drive for the strip dispenser, the matching between ejection velocity and the transport velocity of the mail processing machine is problematical. Given a difference between these velocities, print offsets can occur in the print image. The maximum offset occurs when the drive in the strip dispenser is deactivated immediately after the isolation. Depending on the geometric dimensions in the region between strip ejection and printing region, for a particular strip length it may occur that a portion of the strip still sticks into the strip dispenser while the front part of that strip is already being printed. It is clear that a reloading during operation is not possible here.

Furthermore, a strip dispenser for mail processing machines is known (see U.S. Pat. No. 6,773,524 B2) that has a strip magazine in which the strips are stacked one after another, resting with their leading edges on a base plate. The mail processing machine has a transport system that has multiple parallel (upper and lower), revolving transport belts actively driven by rollers. The strip magazine has a matching slit located centrally relative to one of the upper transport belts in the outermost region of the forward driven roller. The strip take-off position is centrally established by an electromagnet that pulls the slit of the magazine into the engagement region of this transport belt. If the electromagnet is not fed with current, the magazine remains pivoted away and no strip is taken. The removed strip is initially non-positively taken along by the upper transport belt through the slit between floor plate and transport belt, then strikes with its leading edge on the lower transport belt and is deflected by the lower transport belt and is directed further. In the subsequent printing position, the strip segment located there lies only on the lower transport belt opposite the printheads. A correspondingly designed counter-pressure element might not be necessary.

The strips must be situated at a defined angle relative to the base plate so that they are not excessively curved and safely arrive at the slit to the transport belt. If they are wavy or do not have a smooth cut edge, this can lead to malfunctions. Different flexural strengths of the webs can likewise have a disadvantageous effect. In this solution there is also the risk that, upon insertion of one or a few strips, the strip or strips may already have slid into the output slit, which results in the errors described above. The transport system is complicated and requires a precise matching between the upper and lower transport belts.

In addition, a transport module is cited (see DE 10 2007 060 789 A1) that is arranged above a feed table and (in a known manner) has a transport belt for flat print media. The print media, arriving from the feed table, are pressed against the transport belt by means of elastically arranged, spring-loaded pressure elements (advantageously brush elements) below the transport belt. Due to a number of such contact pressure elements, a correspondingly large contact area is achieved, so start-stop errors in the print image are largely avoided (see FIGS. 2 and 3).

Finally, a transport device for flat goods to be printed is known (see DE 10 2008 032 804 A1) that has a driven, revolving transport belt supported on rollers. A number of spacers that are axially parallel to one another are arranged between one end of a bearing plate of a roller support and a first shaped plate, and a number of spacers axially parallel to one another are likewise arranged between the other end of the bearing plate and a second shaped plate. The spacers are all identical and designed as bearing shafts. Respective tensioning means are mounted at the ends of the bearing plate of the roller support and are designed for force transmission from a connecting rod. For a defined flexing of the roller support with corresponding loading of the bearing plate, a mechanical draw tension is transmitted via the tensioning means to the two ends of the bearing plate. The connecting rod is provided with tensioning and adjustment means to adjust a defined draw tension (see also FIGS. 2 and 3).

The last two cited solutions, matched to one another, form a compact transport device for franking machines with small to medium of mail items throughput; see also Design Patent registration with the Office of Harmonization for the Internal Market, file number 001292361-0001 and FIGS. 1 through 3.

SUMMARY OF THE INVENTION

An object of the present invention is to increase the print quality and reliability with decreased technical cost in an arrangement to print strip-like print media, which also exhibits low wear and decreased need for maintenance.

A further object of the invention is to achieve an arrangement of the aforementioned type that operates without separate drive means and with an easily exchangeable strip dispenser module for strips of different lengths and thicknesses as well as different flexural strengths, and that achieves the same print quality in the transport path with the sensor technology for the otherwise typical print media.

Disadvantageous effects as a result of insertion errors given one or a few strips should be precluded by means of the application technology. A refilling of strips during the take-off should be possible.

The above object is achieved in accordance with the present invention by an arrangement for printing strip-like print media in a franking and/or addressing machine wherein the print media are transported by a revolving transport belt of a transport module, and are printed with a printhead that is located behind a printing window. A module that includes a magazine for the strip-like print media is located at the entrance region of the transport module in an engagement region of the transport belt thus also serves as a take-off device for removing individual items to be printed from the magazine. The module with the magazine is located laterally offset from the transport belt, so that the print media are captured by the transport belt only at an edge region thereof, and the transport belt is wider by this edge region than would be necessary for otherwise typical print media. The transport belt proceeds outside of and next to the print window. A remaining region, next to the edge region, of each item to be printed was thereby caused by the transport belt to be transported past and below the print window, for printing on this remaining region by the printhead.

Due to the laterally offset arrangement of the module relative to the transport module, the strip-like print media—strips in the following—are already aligned resting on their lateral edges upon removal from the magazine. The longitudinal edge of the strip and transport track are therefore parallel to one another, and the required print image clearance from the longitudinal edge of the strip is furthermore also ensured. The wider embodiment of the strips enables the typical print region, and the already present transport conditions (including sensor technology), to be maintained without changes. Based on empirical tests, the edge region of the strip that is provided for the transport (and therefore the module offset) is chosen to be so wide (at least one third of the print region width) that a safer transport is ensured by the transport module. The edge region can appropriately be provided with an identifier (arrow) in order to facilitate the correct filling of the magazine. The additional space is also suggested for advertising purposes. Given self-adhesive design of the strip, a subdivision of it matching the transport strips is advantageous; the later take-off of the printed part is thereby facilitated.

The special embodiment of the module according to the invention enables the optional configuration of the franking machine with or without strip printing and without additional space requirement.

The incorporation of the flap in the input region of the device housing into the strip magazine enables the opening for the strip input to be kept as small as possible, the housing to be sealed against access and the module to be adapted without any problems.

By adjusting the magazine from the pivoted-away position into the take-off position and back with the aid of a stepper motor with gearwheel and associated toothed segment on an axle with activation curve profile, a catch is reached for each position; a holding current is omitted. It is clear that a continuous adjustment of the exit conditions corresponding to the strip quality is thereby possible.

In the pivoted-away position of the magazine, the division of the floor of the magazine into a rigid, smooth part and a rotationally movable, elbowed part prevents individual strips from sliding through upon filling, and ensures a certain individualization afterward. In the take-off position, the rigid, flat part of the floor wall initially rests spring-loaded on the transport belt; the sluice is closed. The removed strip is subsequently pushed into the sluice. In this way an adapted, elastic sluice is formed for strips of different thicknesses, and the exit of only one strip is respectively enabled. Since only the contact region of the contact lever is significant for the take-off, a reloading can take place without any problems during the take-off operation.

In the take-off position, the combination of magazine with contact pressure lever and rigid, smooth resting part of the floor wall, as well as associated baffle plate with spring tabs above the letter thickness sluice, produces at least the triple contact of the strip with the transport belt, and therefore a high certainty of take-off and transport.

In the pivoted-away position, the equipment of the magazine with a touching lever with two switching plates and associated photoelectric barriers enables a simple fill level monitoring with regard to the empty state or overfilling.

DESCRIPTION OF THE PREFERRED EMBODIMENTS

Figure 1:
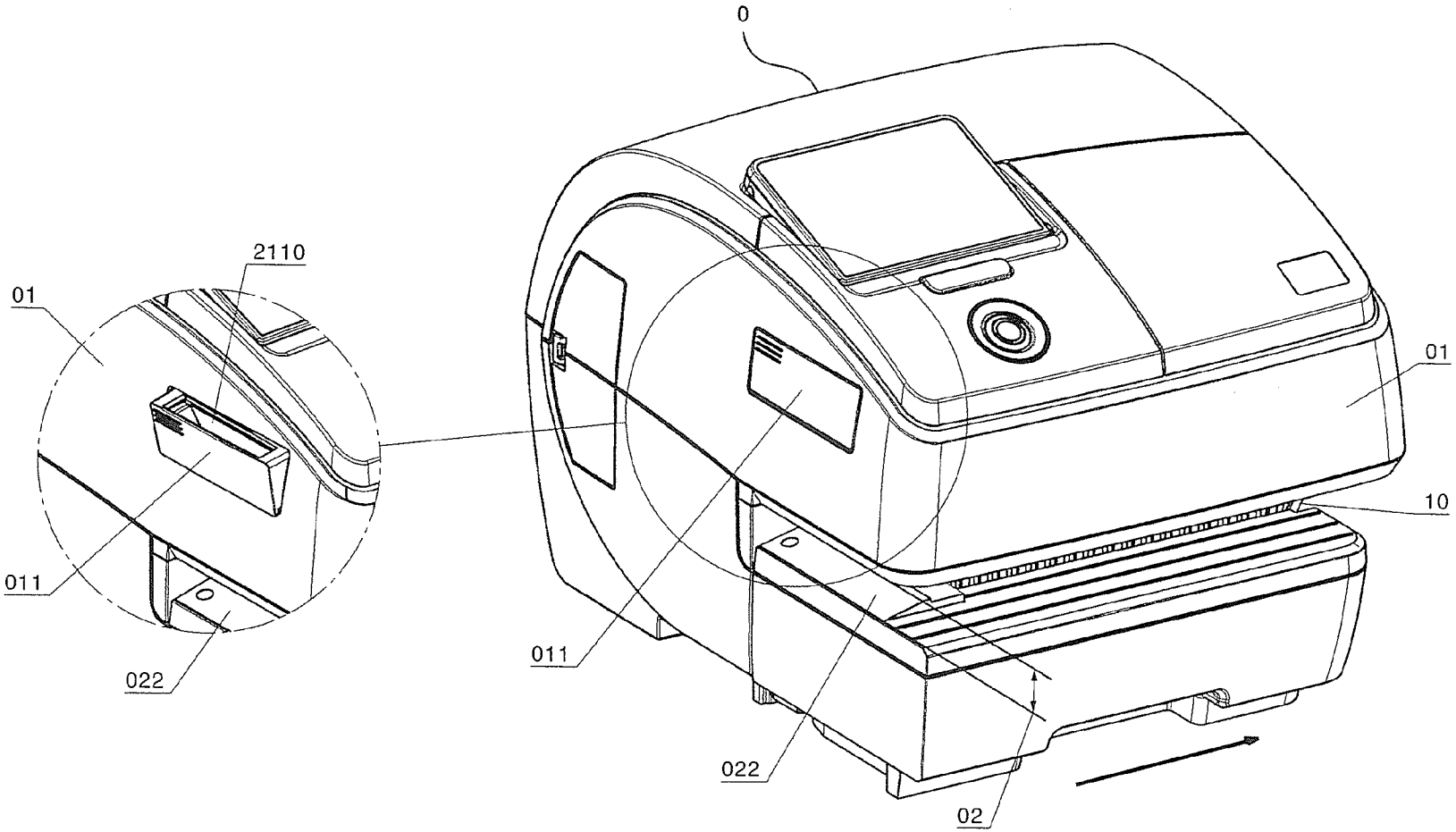
FIG. 1 is a perspective view of a franking machine according to design patent registration 001292361-0001 with assembly for strip printing.

According to FIG. 1, a franking machine 0 is laterally provided via the input region 02 in the apparatus housing 01 with a flap 011. The flap 011 can be pivoted forward so that a filling opening (opening upward) of a magazine 21 (see FIG. 5) for the strips 3 is created; see detail. The flap 011 is simultaneously the rear wall of the magazine 21 and is non-positively coupled with its u-shaped upper forward wall 2110 so that this is simultaneously pivoted inward upon closing the flap 011.

If the franking machine 0 is not assembled for strip printing, the flap 11 remains permanently closed (and locked) so that manipulations of the franking machine 0 are not possible via this path.

Figure 3:
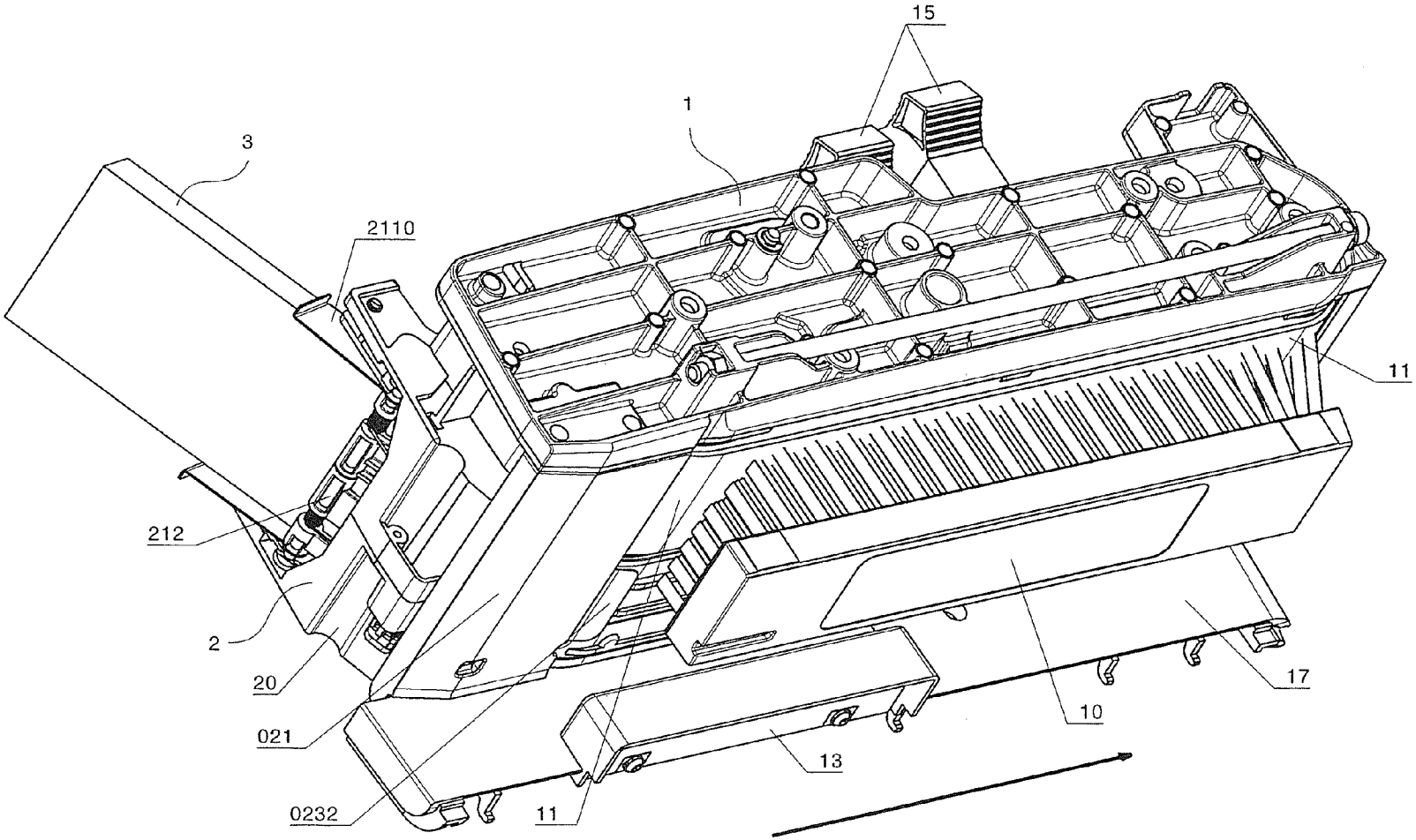
FIG. 3 is a perspective view of a counter-pressure device for the transport module according to DE 10 2007 060 789 A1 and FIG. 3, with a module for strip-like print media.

The input region 02 of the franking machine 0 has what is known as a letter thickness sluice that is formed by an upper plate 021 and a lower plate 022; see also FIG. 3. The maximum letter thickness (10 mm, for example) is established by the separation of these two plates 021, 022. An additional design of the input region 02 with means for letter thickness detection is possible.

The counter-pressure device 10 of the transport module 1 is apparent in outline in the lower part of the franking machine 0; see also FIG. 3.

Figure 2:
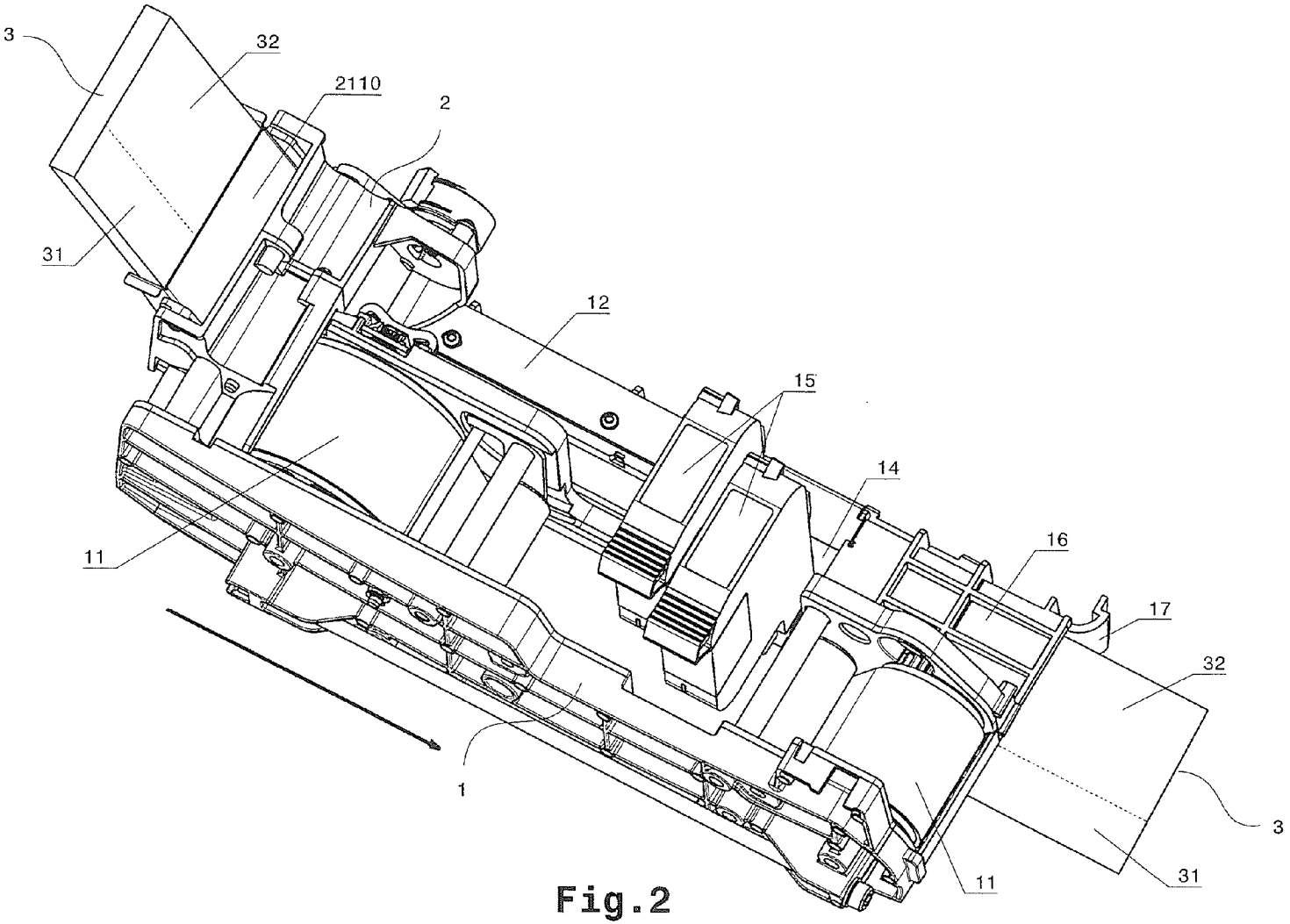
FIG. 2 is a perspective view of the transport device of a transport module according to DE 10 2008 032 804 A1 and FIG. 2, with a module for strip-like print media.

A perspective plan view of a transport module 1 with a module 2 for strips 3 is shown according to FIG. 2. The transport module 1 has a revolving transport belt 11 directed over rollers. The drive roller—not designated specifically—is arranged in the output region of the franking machine 0. Two printheads 15 are offset across a print window 14 so that printing can take place across the full width of the print region 32 of the strip 3. The strip 3 is taken up with its edge region 31 (transport region) by the transport belt 11. The revolution direction of the transport belt 11 travels in the counter-clockwise direction; see also the thick arrow. The upper letter travel guide 16 and the lateral letter travel guide 17 serve to guide the typical letters (see also FIG. 3).

According to FIG. 3, the counter-pressure device 10 is arranged non-positively at the transport belt 11. A circuit board 13 with transmitter-side letter travel sensors 131, 132 and 133 is attached below to the lateral letter travel guide 17. The associated counterpart is a circuit board 12 with receiver-side letter travel sensors 121, 122, 123 (not shown) above at the letter travel guide 16 (see FIG. 2 in this regard).

Figure 7:
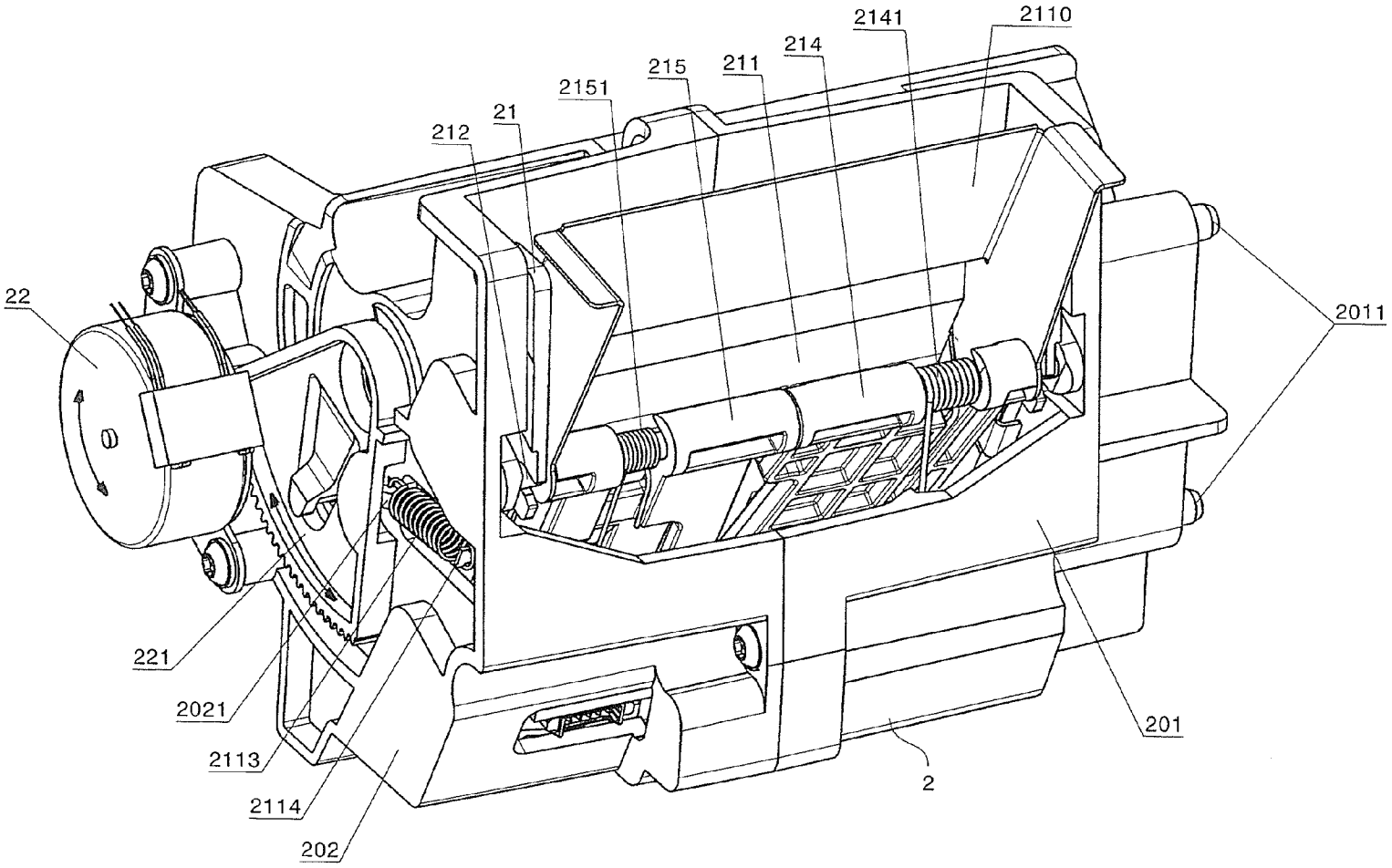
FIG. 7 is a perspective view of a module for strip-like print media with a stepper motor for defined adjustment of the module relative to the transport belt, as seen in the transport direction from the front left.

The upper forward wall 2110 of the magazine 21 is arranged spring-loaded so as to be movable in rotation around the axis 212 (see also FIG. 7). The free end of the baffle flap 0232 of the baffle plate 023 for the module 2 protrudes out from the plate 021 (top of the letter thickness sluice) in the transport direction, next to the transport belt 11 (see also FIG. 4). The module 2 has a module housing 20 to accommodate the magazine 21 (see also FIG. 5).

Figure 4:
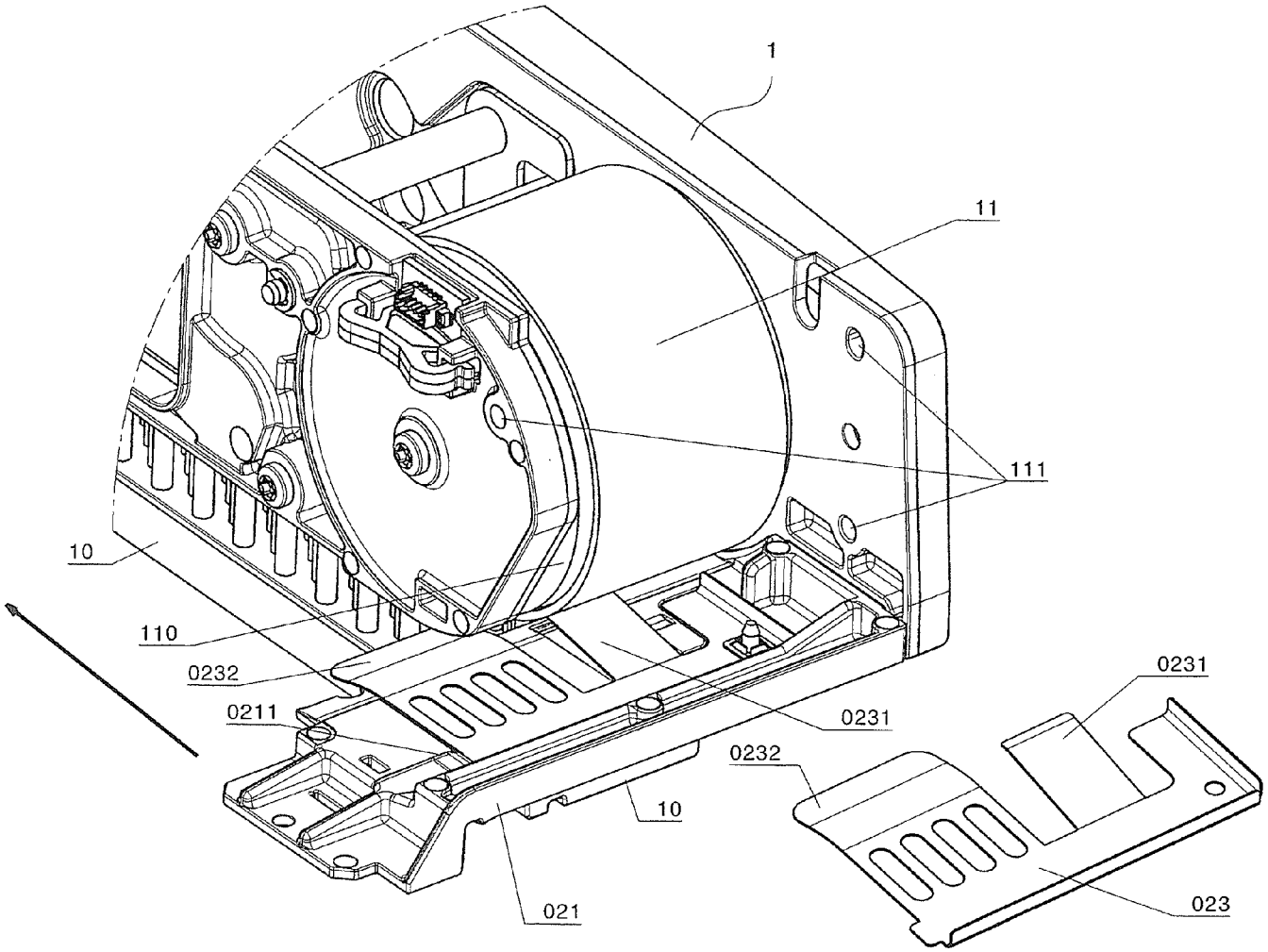
FIG. 4 is a detail of the input region with letter thickness sluice at the top, in perspective view.

The adjustment and fixing of the baffle plate 023 for the module 2 in the plate 021 (top of the letter thickness sluice) is shown in FIG. 4. The baffle plate 023 ends in two parallel tabs 0231, 0232. A spring tab 0231 is non-positively applied on the transport belt 11. The baffle flap 0232 deflects the strip 3 into the engagement region of the counter-pressure device 10. The baffle flap 0232 is arranged near the transport belt 11 and is adapted to its curvature (see also FIG. 10). The deflection roller 110 for the transport belt 11 is provided with an encoder wheel (not designated) that serves to measure distance for the print line to be printed.

Mounting holes 111 for the mounting pins 2011 (see also FIG. 7) of the module 2 are provided in the support frame of the transport module 1. A defined position of the module 2 relative to the transport module 1 is therefore achieved.

Figure 5:
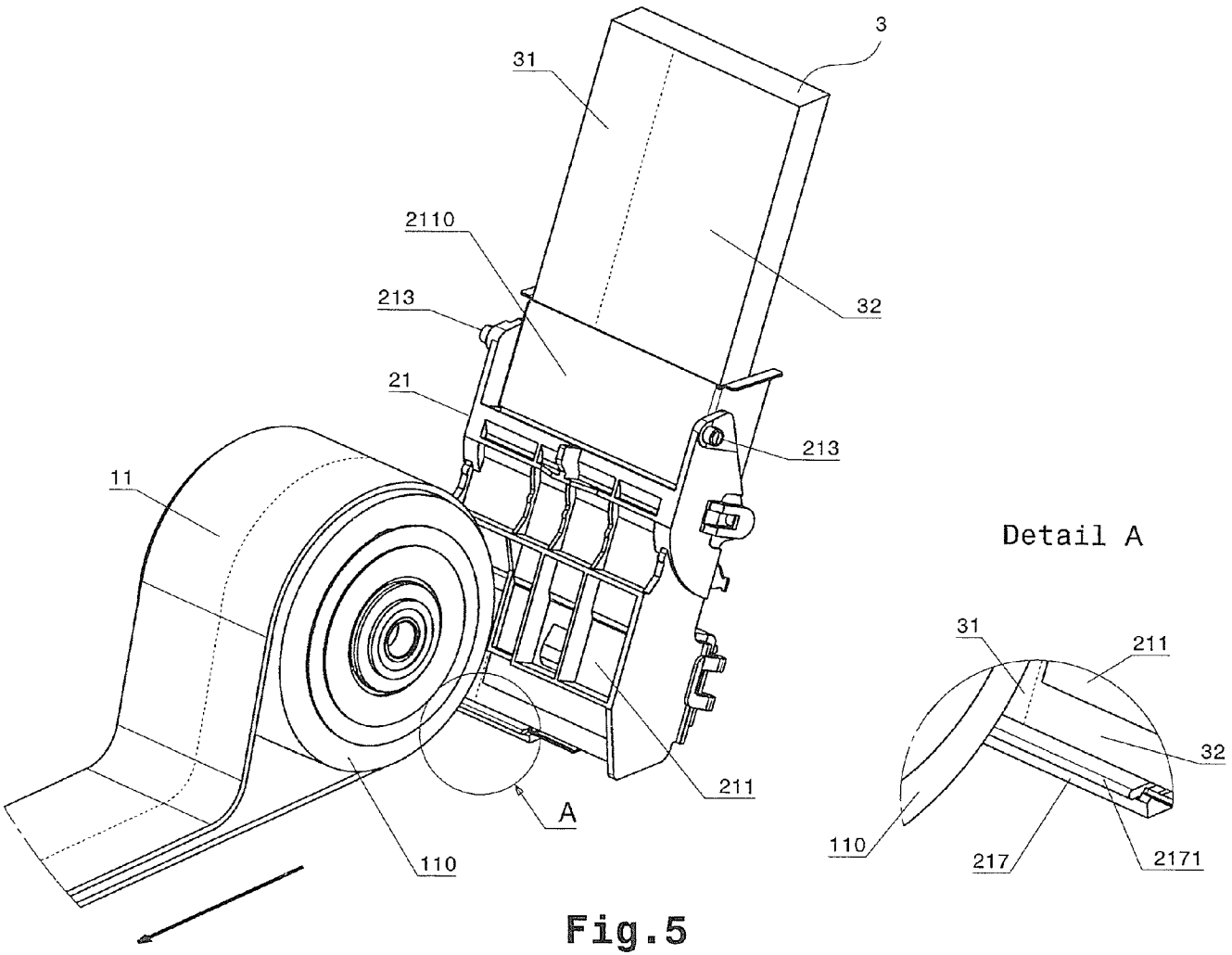
FIG. 5 is a perspective view of a module for strip-like print media, counter to the transport direction, as seen from the rear right.

The offset position of the module 2 and the magazine 21 thereof relative to the transport belt 11 is clearly visible in FIG. 5. Only the narrower region (see stippling) of the transport belt 1 serves for the transport of the strips 3 with the edge region 31. The front wall 211 of the magazine 21 is notched correspondingly (adapted to the transport module 1) for this. The magazine 21 is suspended with the pins 213 in the module housing 20 (see also FIG. 8).

At least the part 2171 of the floor wall 217 of the magazine 21 that is situated in the engagement region of the transport belt 11 is executed as a rigid, smooth part (see Detail A). A metal plate with rounded facing profile with low coefficients of friction is advantageously glued on. A corresponding ceramic plate would also be possible.

Figure 6:
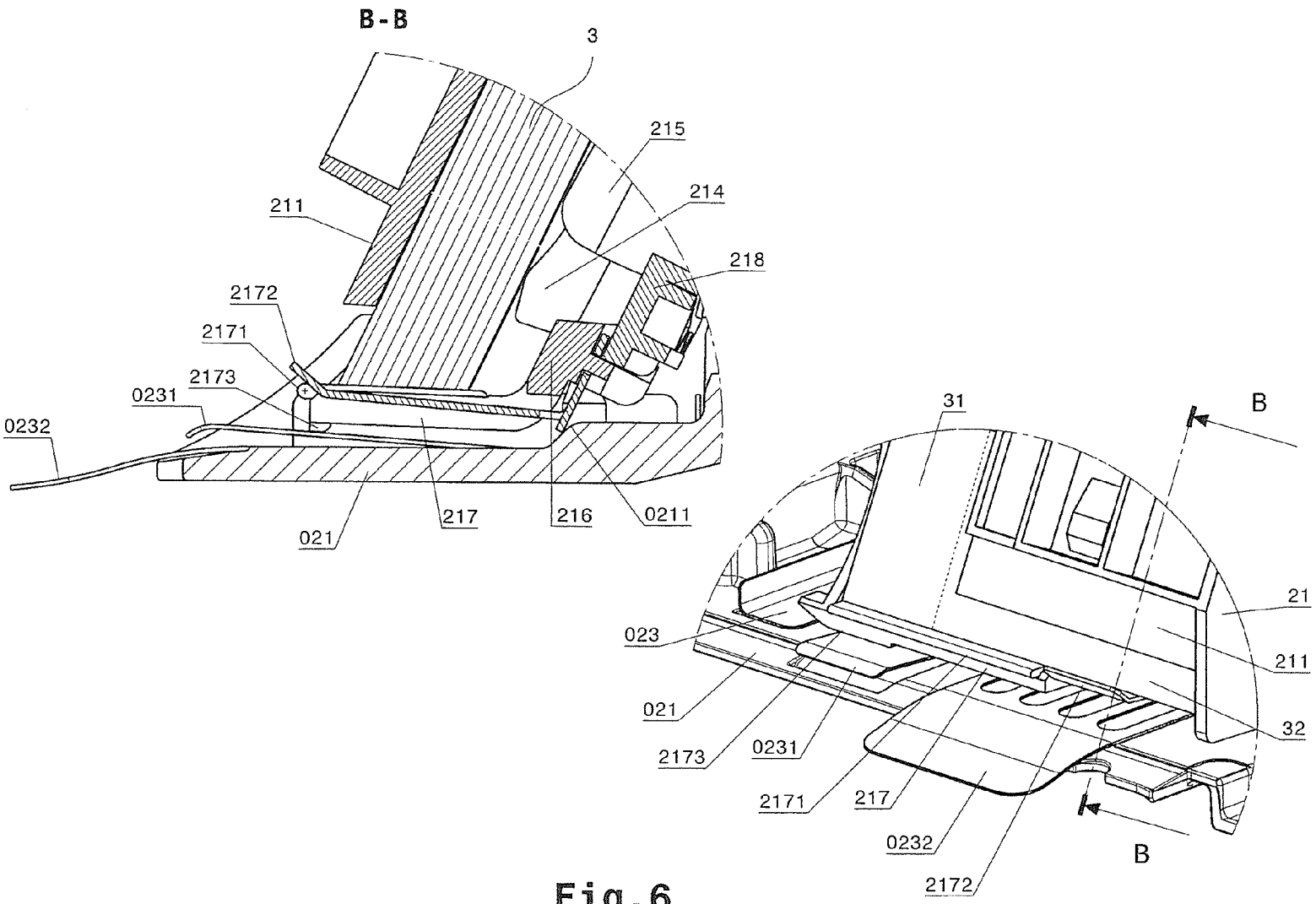
FIG. 6 shoed details of FIGS. 4 and 5, partially in section.

Additional details regarding FIGS. 4 and 5 are shown in FIG. 6. The magazine 21 is shown in the pivoted-away position relative to the transport belt 11. In this position, the rear part of the elbowed part 2172 of the floor wall 217 is pressed against a contour 0211 in the upper plate 021 of the letter thickness sluice 02. As a result of this, the front part of the elbowed part 2172 is pivoted upwardly. The magazine 21 is filled with a stack of strips 3 that is pressed by means of a contact pressure lever 214 against the front wall 211 of the magazine 21. The fill level is monitored with the touching lever 215. The strips stand with their lower facing edges on the smooth, rigid part 2171 of the floor wall 217. With its raised leading edge, the elbowed part 2172 of the floor wall 217 prevents an exit of strips from the magazine 21. A function support 218 for a circuit board 2180 is attached to the lower rear wall 216 of the magazine 21 (see FIGS. 11 and 12).

A complete module 2 is shown in FIG. 7 as viewed from the front left. The module housing 20 (see also FIG. 2) is assembled from a right part 201 and a left part 202 and includes the magazine 21 (see also FIG. 8). The upper, movable front wall 2110 of the magazine 21 is borne such that it can rotate around the axle 212 and is tensioned by means of a tension spring 2113. The tension spring 2113 is suspended with one end in a tab 2114 of the front wall 2110 below the axle 212 and attached with the other end in a nose 2021 of the left part 202 of the module housing 20. The contact pressure lever 214 with associated spiral torsion spring 2141 and the touching lever 215 with associated spiral torsion spring 2151 are likewise arranged next to one another on the axle 212. The axle 212 itself is borne in side walls of the magazine 21. A stepper motor 22 with gearwheel (not shown) is attached to the side at the left part 202 of the module housing 20, which serves to drive a toothed segment 221.

Figure 8:
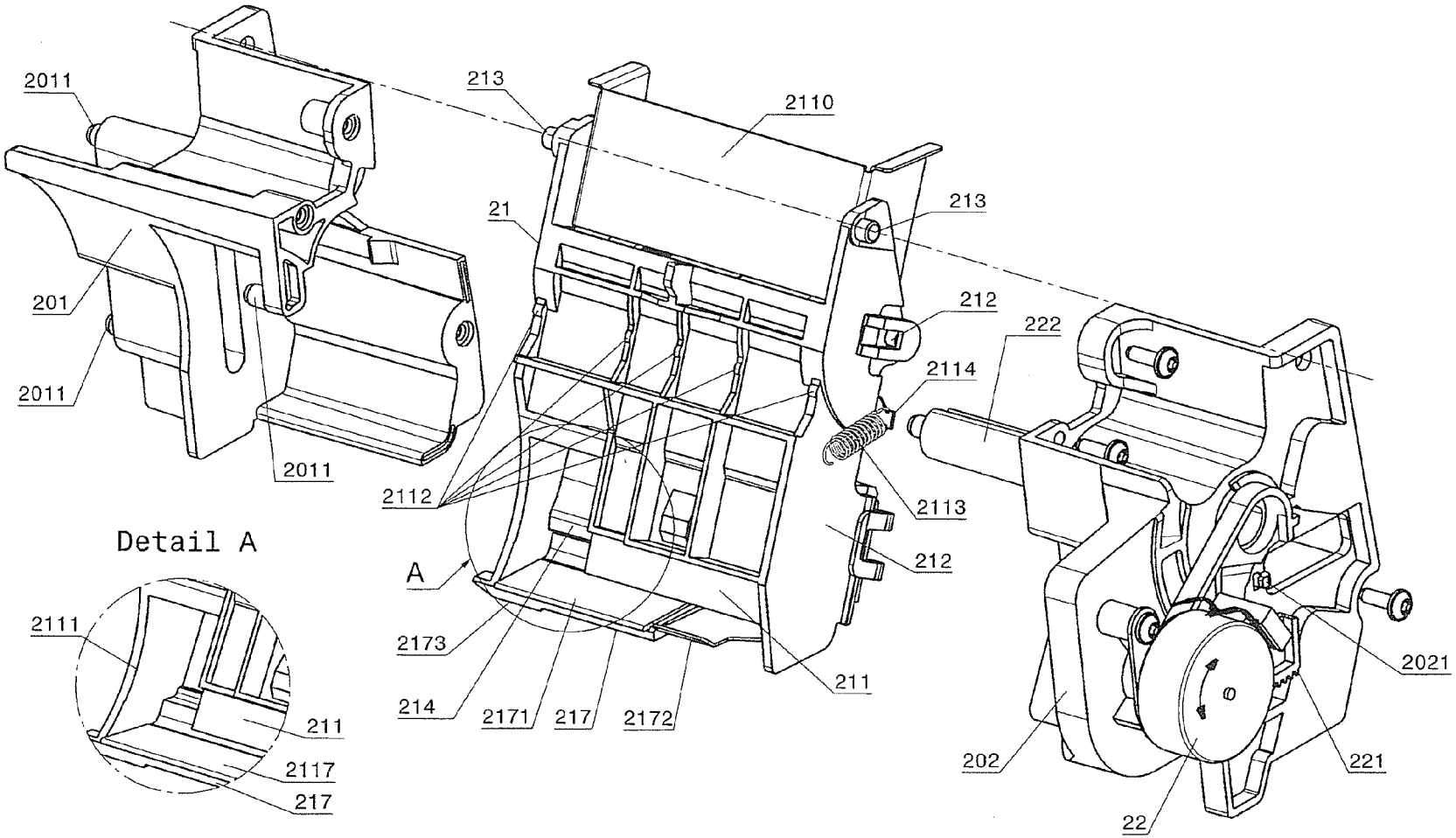
FIG. 8 is an exploded view of a module according to FIG. 7.

The design of the module 2 is more clearly apparent in FIG. 8 in an exploded presentation. In particular, it is clear that the toothed segment 221 forms a unit with an axle 222 with activation curve profile that is borne between two parts 201, 202 of the module housing 20 parallel to the axle 212. The axle 222 engages with its profile in an opposite contour 2112 of the outer front wall 211 of the magazine 21. The distance of the rigid, smooth part 2171 of the base wall 217 of the magazine 21 from the transport belt 11 is continuously adjustable in this manner, and therefore the sluice opening for the strips 3 can be set (see also Detail A).

Figure 9:
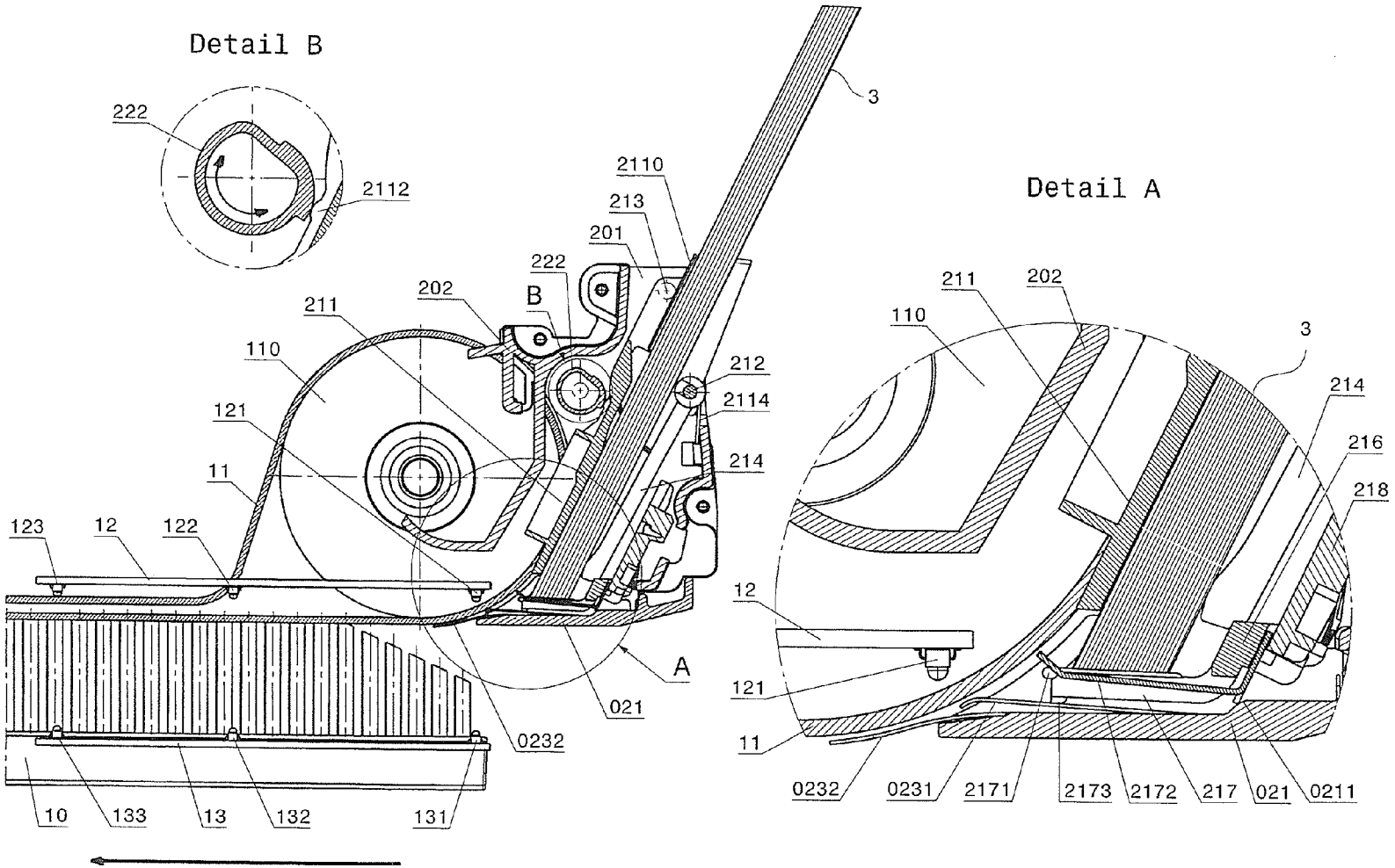
FIG. 9 is a side view of the module outside of (pivoted away) the engagement region of the transport belt in section.

The relationships given a pivoted-away magazine 21 are shown in section in side view in FIG. 9, in particular Detail A. In the magazine 21 (see also FIG. 8), the stack of strips 3 rests non-positively (as a result of contact pressure lever 214) with the front-most strip on the lower front wall 211. The facing side of the elbowed part 2172 of the floor wall 217, the exit end of the tab spring 0231 and of the baffle flap 022 of the baffle plate 023 are normally distanced from the transport belt 11. As an exception, it can be desired to leave the tab spring 0231 in contact with the transport belt 11 in order to securely transport away the end of the currently taken strip 3. The facing part of the tab spring 0231 is then advantageously to be provided with a sliding layer.

The interaction of axle 222 with activation profile and opposite contour 2112 of the front wall 211 is easily recognizable in Detail B. As long as the projecting part of the eccentric axle 222 strikes the bead of the opposite contour 2112 of the front wall 211, the magazine 21 remains pivoted away. The translation relationships between gearwheel of the step motor 22, toothed segment 221 and axle 222 can be selected so that a less powerful motor is sufficient and a catch is present; a holding current is consequently done away with.

As a supplement to FIG. 3, the arrangement of the circuit boards 12 and 13 with the associated letter travel sensors 121, 122, 123 and 131, 132, 133 relative to the transport belt 11 and counter-pressure device 10 is visible.

Figure 10:
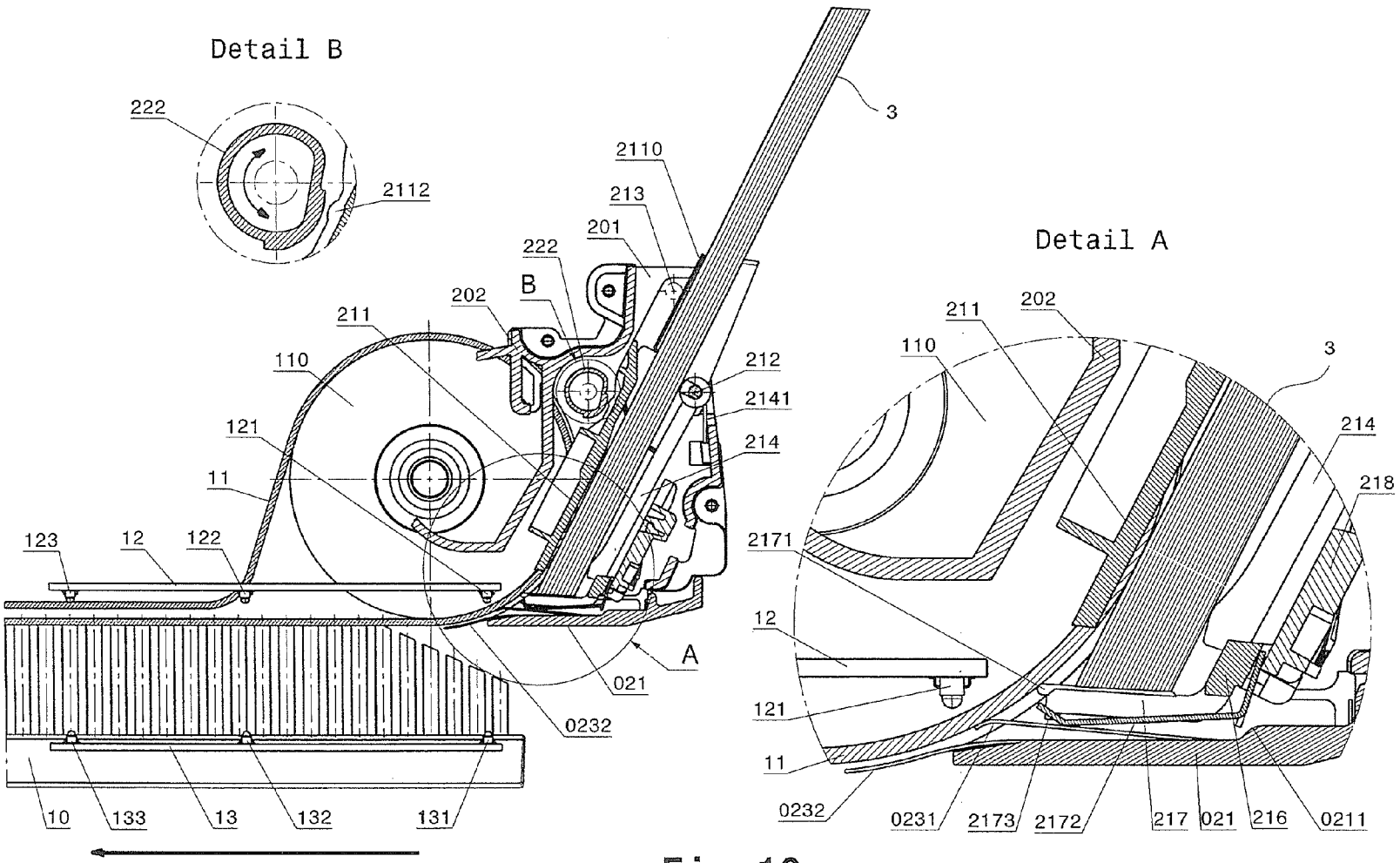
FIG. 10 is a side view of the module in the engagement region (take-off position) of the transport belt in section.

The relationships given a pivot-forward magazine 21 in a side view in section are shown in FIG. 10 (in particular Detail A); that is the take-off position. The magazine 21 is pivoted so far forward that the deflection roller 110 with the transport belt 11 protrudes into the recess 2111 of the lower front wall of the magazine 21 (see FIG. 8, Detail A). As a result of this, the forward-most strip 3 rests positively on the transport belt 11 and is taken along by this by static friction, is deflected at the magazine floor and consequently matches the curvature of the deflection roller 110. The elbowed part 2172 of the floor wall 217 has left the contour 0211 of the plate 021, so its free end falls downwardly and releases the strip 3. The exit end of the spring tab 0231 of the baffle plate 023 initially rests on the transport belt 11 before the strip 3 arrives between them. With its rounded front profile and the transport belt 11, the smooth part 2171 initially forms a wedge-shaped, closed intake angle into which the front-most strip 3 is securely pressed due to the static friction with the transport belt 11. Since the magazine 21 is elastically spring-loaded, the now open intake angle or the strip sluice is flexibly adapted to different strip thicknesses. The strip 3 presses the sluice only until this is passed through. The static friction required for the take-off (and consequently the feed force) is not sufficient for the strip situated after this.

If the start of the strip 3 is located in the region of the first sensor pair (the input sensor 121, 131), strip take-off is signaled. The second sensor pair is the print image sensor 122, 132 and the third sensor pair is the print start sensor 123, 133. The print image sensor 122, 132 is used both for the preparation of the print image and the control of the magazine position. If the start of the strip arrives at the print image sensor 122, the signal to pivot the magazine 21 away is emitted to the step motor 22 with a delay (see also FIG. 7).

Since the thickness fluctuations of the strips are far less in comparison to typical letters, a significantly higher print quality is achieved given unmodified transport conditions.

Figure 11:
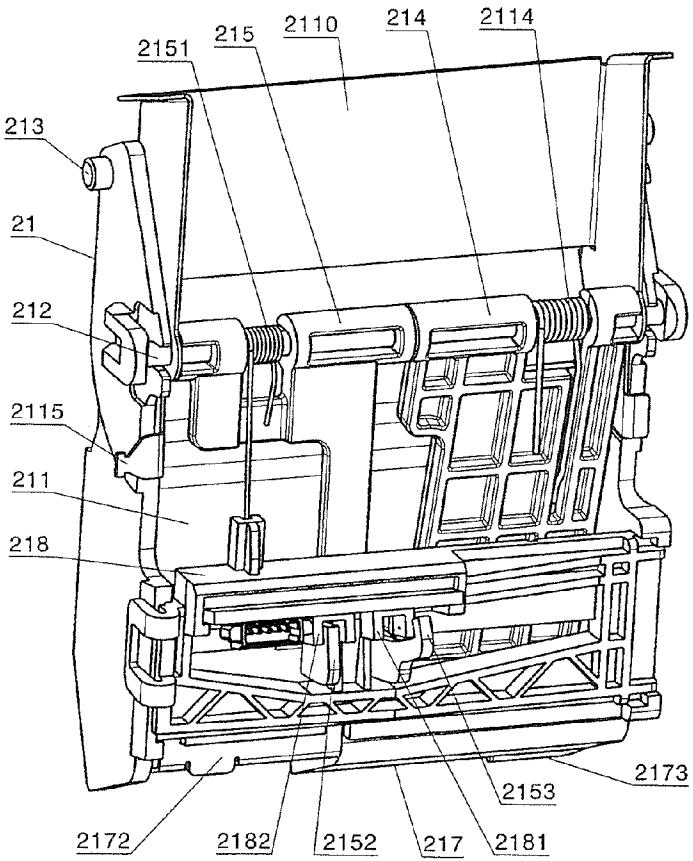
FIG. 11 is a perspective view of a magazine in the transport direction, as viewed from the front left.

The arrangement of the touching lever 215 for the fill level monitoring and the function support 218 with the circuit board 2180 relative to one another is shown in the view according to FIG. 11. The free leg of the touching lever 215 is provided at its end with two elbowed switching plates 2152, 2153 of different lengths that act on associated photoelectric barriers 2181, 2182 depending on the position of the touching lever 215. The photoelectric barriers 2181, 2182 are designed as forked photoelectric barriers with aperture and are attached on the circuit board 2180.

Figure 12:
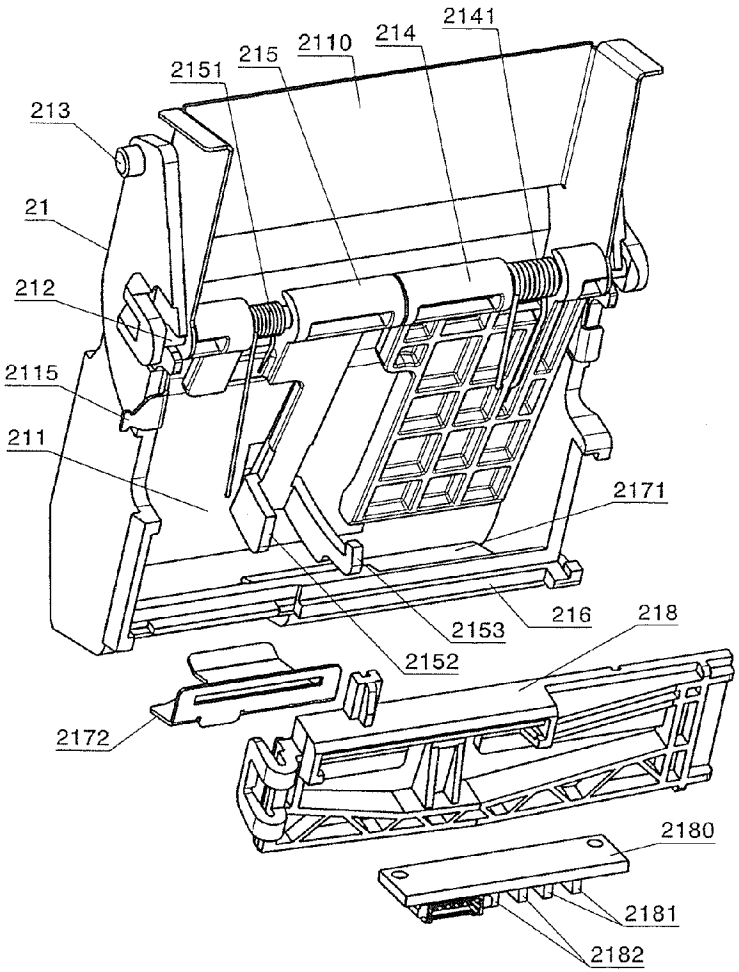
FIG. 12 is an exploded view (in part) of a magazine according to FIG. 11 showing details regarding the fill level monitoring.

The size ratios of the two switching plates 2152, 2153 are easily seen in FIG. 12. If too many strips 3 are slid into the magazine 21, the shorter switching plate 2152 interrupts the photoelectric barrier 2182. Enough strips 3 must be removed so that the photoelectric barrier 2182 is free again. Given an empty state, the touching lever 215 is pivoted so far forward into a recess (not designated in detail) of the front wall 211 that, due to this path relationship, the longer switching plate 2153 securely triggers the photoelectric barrier 2181 even given thin strips 3.

Although modifications and changes may be suggested by those skilled in the art, it is the intention of the inventors to embody within the patent warranted hereon all changes and modifications as reasonably and properly come within the scope of their contribution to the art.

We claim as our invention:

1. A printing apparatus for printing on strip-like print media, comprising:

a printhead located behind a printing window in an apparatus housing;

said apparatus housing comprising a transport module therein comprising a moving transport belt configured to transport print media past said printhead, said transport module comprising an entrance region upstream of said printhead, and said housing comprising a housing opening, upstream of said entrance region, though which said print media enter said housing in order to proceed to said entrance region;

said transport belt having a belt width comprising a basic region having a basic region width sufficient to transport said print media past said print window with an orientation relative to said printhead that causes said printhead to print indicia on said print media conforming to a predetermined standard;

a magazine configured only to receive a stack of for said strip-like print media said magazine being located upstream of said entrance region of said transport module, so that said strip-like media proceed to said entrance region from said magazine and not through said housing opening said strip-like print media comprising an indicia-receiving portion having a first width dimensioned to receive said indicia printed thereon by said printhead, and an edge region, adjacent said indicia-receiving portion, having a second width, said strip-like media having a total width consisting of said first width and said second width;

said transport belt width further comprising a belt edge region, adjacent said basic region, that extends said belt width of said transport belt beyond said basic region and that has a belt edge region width equal to said second width;

said magazine being mounted in said housing laterally offset with respect to said transport belt in order to cause said strip-like print media to be captured from said magazine by said transport belt only by frictional engagement of said edge region of said strip-like media with said belt edge region of said transport belt.

2. An apparatus as claimed in claim 1, wherein:

said transport belt comprises an axle proceeding parallel to a plane along which said transport belt transports said strip-shaped print media, said axle being attached centrally at a backside of said magazine;

said magazine has a U-shaped, upper front wall that is spring loaded and elastically pivotable around said axle, and an upper rear wall formed by a sealable flap of said housing;

and wherein said apparatus further comprises:

a spring loading mechanism that spring-loads an entirety of said magazine making said magazine pivotable and adjustable by motor actuation with two pins in said entrance region, thereby permitting adjustment of take-off of said strip-like print media from said magazine;

said magazine having a front wall with a recess therein adapted to said transport module at a region of engagement with said transport belt, and a contact pressure lever spring-loaded for pivoting with respect to said axle following said recess; and a touching lever also spring-loaded for pivoting with respect to said axle, parallel to said contact pressure lever on said axle, for monitoring a fill level of said magazine when said magazine is filled with a stack of said strip-like print media that is pressed by said contact pressure lever against said front wall of the magazine, with said magazine comprising a lower rear wall with a plurality of transitions, adapted in shape, to a base wall of said magazine, below said contact pressure lever, into a rotationally movable part that has an angled upwardly proceeding projection at a free end thereof.

3. An apparatus as claimed in claim 2 wherein said axle is a first axle, and further comprising:

a stepper motor having a gearwheel;

a toothed segment connected to a second axle, said toothed segment engaging said gearwheel and having an activation curve profile that causes said second axle to engage in opposite contour of said outer front wall of said magazine, said second axle being parallel to said first axle and said gearwheel and said toothed segment having a translation relative to each other that generates three successive, self-locking positions comprising a take-off position, an intermediate position, and a pivoted-away position, allowing exiting conditions of said strip-shaped print media to be adjustable by operation of said stepper motor.

4. An apparatus as claimed in claim 3 further comprising:

a baffle plate in said housing at an upper plate of sluice proceeding between opposite ends with two parallel tabs, a spring tab and a baffle flap, said spring tab non-positively resting on said transport belt or said strip-like printing media while said baffle flap is located spaced from said transport belt and adapted to a curvature thereof, and deflecting said strip-like print media into an engagement region of a counter-pressure device for said transport belt.

5. An apparatus as claimed in claim 4 further comprising mounting pins that fix a module comprising said magazine in mounting holes of a support plane of said transport module, producing a defined positional relationship of said magazine relative to said transport belt.

6. An apparatus as claimed in claim 1, wherein:

said transport belt comprises an axle proceeding parallel to a plane along which said transport belt transports said strip-shaped print media, said axle being attached centrally at a backside of said magazine;

said magazine has a U-shaped, upper front wall that is spring loaded and elastically pivotable around said axle, and an upper rear wall formed by a sealable flap of said housing;

and wherein said apparatus further comprises:

a spring loading mechanism that spring-loads an entirety of said magazine making said magazine pivotable and adjustable by motor actuation with two pins in said entrance region, thereby permitting adjustment of take-off of said strip-like print media from said magazine;

said magazine having a front wall with a recess therein adapted to said transport module at a region of engagement with said transport belt, and a contact pressure lever spring-loaded for pivoting with respect to said axle following said recess;

a further lever also spring-loaded for pivoting with respect to said axle, parallel to said contact pressure lever, for fill level monitoring, with said magazine comprising a lower rear wall with a plurality of transitions, adapted in shape, to a base wall of said magazine, below said contact pressure lever, into a rotationally movable part that has an angled upwardly proceeding projection at a free end thereof; and said base wall of said magazine comprising a smooth portion having a smooth portion having a plate with a grounded facing profile with a low coefficient of friction that, in a take-off position of said magazine forms a wedge-shaped, elastic intake angle with said transport belt into which a reading edge of said print-shaped strip media is pushed by static friction with said transport belt.

7. An apparatus as claimed in claim 1, wherein:

said transport belt comprises an axle proceeding parallel to a plane along which said transport belt transports said strip-shaped print media, said axle being attached centrally at a backside of said magazine;

said magazine has a U-shaped, upper front wall that is spring loaded and elastically pivotable around said axle, and an upper rear wall formed by a sealable flap of said housing;

and wherein said apparatus further comprises:

a spring loading mechanism that spring-loads an entirety of said magazine making said magazine pivotable and adjustable by motor actuation with two pins in said entrance region, thereby permitting adjustment of take-off of said strip-like print media from said magazine;

said magazine having a front wall with a recess therein adapted to said transport module at a region of engagement with said transport belt, and a contact pressure lever spring-loaded for pivoting with respect to said axle following said recess;

a further lever also spring-loaded for pivoting with respect to said axle, parallel to said contact pressure lever, for fill level monitoring, with said magazine comprising a lower rear wall with a plurality of transitions, adapted in shape, to a base wall of said magazine, below said contact pressure lever, into a rotationally movable part that has an angled upwardly proceeding projection at a free end thereof;

a baffle plate in said housing at an upper plate of sluice proceeding between opposite ends with two parallel tabs, a spring tab and a baffle flap, said spring tab non-positively resting on said transport belt or said strip-like printing media while said baffle flap is located spaced from said transport belt and adapted to a curvature thereof, and deflecting said strip-like print media into an engagement region of a counter-pressure device for said transport belt; and said elbowed part, in a pivoted-away position, being pressed with a rear part against a contour in said upper plate of said sluice, thereby raising said part forward and, in said take-off position, a rear part thereof being spaced from said contour and folding downwardly into said plate by gravity, thereby releasing said strip-like print media from said magazine.

8. An apparatus as claimed in claim 1, wherein:

said transport belt comprises an axle proceeding parallel to a plane along which said transport belt transports said strip-shaped print media, said axle being attached centrally at a backside of said magazine;

said magazine has a U-shaped, upper front wall that is spring loaded and elastically pivotable around said axle, and an upper rear wall formed by a sealable flap of said housing;

and wherein said apparatus further comprises:

a spring loading mechanism that spring-loads an entirety of said magazine making said magazine pivotable and adjustable by motor actuation with two pins in said entrance region, thereby permitting adjustment of take-off of said strip-like print media from said magazine;

said magazine having a front wall with a recess therein adapted to said transport module at a region of engagement with said transport belt, and a contact pressure lever spring-loaded for pivoting with respect to said axle following said recess;

a further lever also spring-loaded for pivoting with respect to said axle, parallel to said contact pressure lever, for fill level monitoring, with said magazine comprising a lower rear wall with a plurality of transitions, adapted in shape, to a base wall of said magazine, below said contact pressure lever, into a rotationally movable part that has an angled upwardly proceeding projection at a free end thereof; and said lever having a free leg with two elbowed switching plates of respectively different lengths that interact with respective photoelectric barriers, dependent on a position of said lever.

9. An apparatus as claimed in claim 8 wherein said photoelectric barriers are mounted on a forked mounting element with an aperture therebetween, and are attached to a circuit board connected to the lower rear wall of the magazine, a shorter of said two elbowed switching plates interrupting a first of said photoelectric barriers upon older filling, and a longer of said switching plates interrupting a second of said photoelectric barriers upon an empty state of said magazine, and said lever moving into the recess of the front wall of the magazine causing said first of said photoelectric barriers to be reliably released in the presence of strip-like print media not exceeding said edge region.

10. An apparatus as claimed in claim 1 wherein said second width is at least one-third of said basic region width.

* * * * *